US011239595B2

(12) United States Patent
Sugimoto

(10) Patent No.: US 11,239,595 B2
(45) Date of Patent: Feb. 1, 2022

(54) FEMALE TERMINAL AND FEMALE CONNECTOR

(71) Applicant: SUMITOMO WIRING SYSTEMS, LTD., Mie (JP)

(72) Inventor: Yuki Sugimoto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/953,389

(22) Filed: Nov. 20, 2020

(65) Prior Publication Data

US 2021/0175653 A1 Jun. 10, 2021

(30) Foreign Application Priority Data

Dec. 5, 2019 (JP) ..... JP2019-220498

(51) Int. Cl.

| | |
|---|---|
| ***H01R 13/02*** | (2006.01) |
| ***H01R 13/11*** | (2006.01) |
| ***H01R 13/533*** | (2006.01) |
| ***H01R 13/73*** | (2006.01) |
| ***H01R 13/52*** | (2006.01) |

(52) U.S. Cl.

CPC ..... *H01R 13/11* (2013.01); *H01R 13/5202* (2013.01); *H01R 13/533* (2013.01); *H01R 13/73* (2013.01)

(58) Field of Classification Search

CPC ..... H01R 13/11; H01R 13/10; H01R 13/02; H01R 13/5202; H01R 13/46; H01R 13/533; H01R 13/73; H01R 13/00; H01R 13/193

USPC ..... 439/850–855

See application file for complete search history.

(56) References Cited

U.S. PATENT DOCUMENTS

| | | | | |
|---|---|---|---|---|
| 4,579,409 A * | 4/1986 | Enneper | H01R 13/20 | 439/266 |
| 5,630,738 A * | 5/1997 | Ito | H01R 13/113 | 439/851 |
| 5,800,220 A * | 9/1998 | Feeny | H01R 13/113 | 439/849 |
| 6,244,910 B1 * | 6/2001 | Grubbs | H01R 13/113 | 439/595 |

(Continued)

FOREIGN PATENT DOCUMENTS

JP 2014-160544 A 9/2014

*Primary Examiner* — Harshad C Patel

(74) *Attorney, Agent, or Firm* — Abelman, Frayne & Schwab

(57) ABSTRACT

A female terminal is provided with a tubular connecting tube portion, a male terminal being connected to the connecting tube portion from front, a resilient contact piece configured to resiliently contact the male terminal inserted into the connecting tube portion from a first direction, receiving portions configured to sandwich the male terminal between the resilient contact piece and the receiving portions inside the connecting tube portion, a vibration suppressing portion configured to resiliently contact the male terminal from a second direction intersecting the first direction, and a contact portion configured to sandwich the male terminal between the vibration suppressing portion and the contact portion inside the connecting tube portion. The vibration suppressing portion is provided on a wall portion constituting the connecting tube portion and includes a plurality of deflecting portions deflectable in the second direction.

3 Claims, 18 Drawing Sheets

(56) References Cited

U.S. PATENT DOCUMENTS

| | | | | |
|---|---|---|---|---|
| 6,290,554 | B1 * | 9/2001 | Makita | H01R 13/11 439/852 |
| 6,547,608 | B2 * | 4/2003 | Sato | H01R 13/11 439/851 |
| 7,470,159 | B2 * | 12/2008 | Hara | H01R 13/113 439/595 |
| 7,938,695 | B2 * | 5/2011 | Furutani | H01R 4/185 439/852 |
| 8,944,861 | B2 * | 2/2015 | Amano | H01R 13/113 439/852 |
| 9,105,995 | B2 * | 8/2015 | Tsuji | H01R 13/187 |
| 10,498,064 | B2 * | 12/2019 | Hirano | H01R 13/41 |
| 10,819,057 | B1 * | 10/2020 | Farole | H01R 4/20 |
| 2001/0034167 | A1 * | 10/2001 | Ketelsleger | H01R 13/4223 439/851 |
| 2014/0287635 | A1 * | 9/2014 | Tsuji | H01R 13/113 439/852 |
| 2019/0013594 | A1 * | 1/2019 | Kitamura | H01R 13/115 |

* cited by examiner

FEMALE TERMINAL AND FEMALE CONNECTOR

CROSS-REFERENCE TO RELATED APPLICATIONS

This application is based on and claims priority from Japanese Patent Application No. 2019-220498, filed on Dec. 5, 2019, with the Japan Patent Office, the disclosure of which is incorporated herein in their entireties by reference.

TECHNICAL FIELD

The present disclosure relates to a female terminal and a female connector.

BACKGROUND

A female terminal fitting disclosed in Japanese Patent Laid-open Publication No. 2014-160544 includes a tubular body portion into which a mating male tab is inserted from front, a resilient contact piece deflectable in a vertical direction in the body portion, a receiving portion facing the resilient contact piece and projecting downward, and struck portions formed by cutting and raising parts of left and right side walls to project into the body portion. When being inserted into this female terminal fitting, the male tab is vertically sandwiched by the resilient contact piece and the receiving portion to guarantee an electrical contact between the terminals. At this time, the struck portions of the female terminal fitting make clearances to the male tab in the female terminal fitting smaller and limits a displacement of the male tab in a width direction.

SUMMARY

In the above female terminal fitting, also when the male tab is connected to the female terminal fitting, the clearances to the left and right of the male tab still remain. Accordingly, if a connector including the female terminal fitting of Japanese Patent Laid-open Publication No. 2014-160544 is used over a long period of time in a vibrating environment such as an automotive vehicle, there is a possibility that the male tab is worn due to the rattling of the male tab in the width direction and the electrical contact between the terminals becomes defective.

A technique disclosed in this specification was completed on the basis of the above situation and aims to provide a female terminal fitting capable of suppressing the rattling of a male terminal and preventing a contact failure between the terminals even if the female terminal fitting is used over a long period of time in a vibrating environment.

The present disclosure is directed to a female terminal with a tubular connecting tube portion, a male terminal being connected to the connecting tube portion from front, a resilient contact piece configured to resiliently contact the male terminal inserted into the connecting tube portion from a first direction, a receiving portion configured to sandwich the male terminal between the resilient contact piece and the receiving portion inside the connecting tube portion, a vibration suppressing portion configured to resiliently contact the male terminal from a second direction intersecting the first direction, and a contact portion configured to sandwich the male terminal between the vibration suppressing portion and the contact portion inside the connecting tube portion, the vibration suppressing portion being provided on a wall portion constituting the connecting tube portion, the vibration suppressing portion including a plurality of deflecting portions deflectable in the second direction.

According to the present disclosure, it is possible to suppress the wear of a terminal even in a vibrating environment and ensure the connection reliability of a connector.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
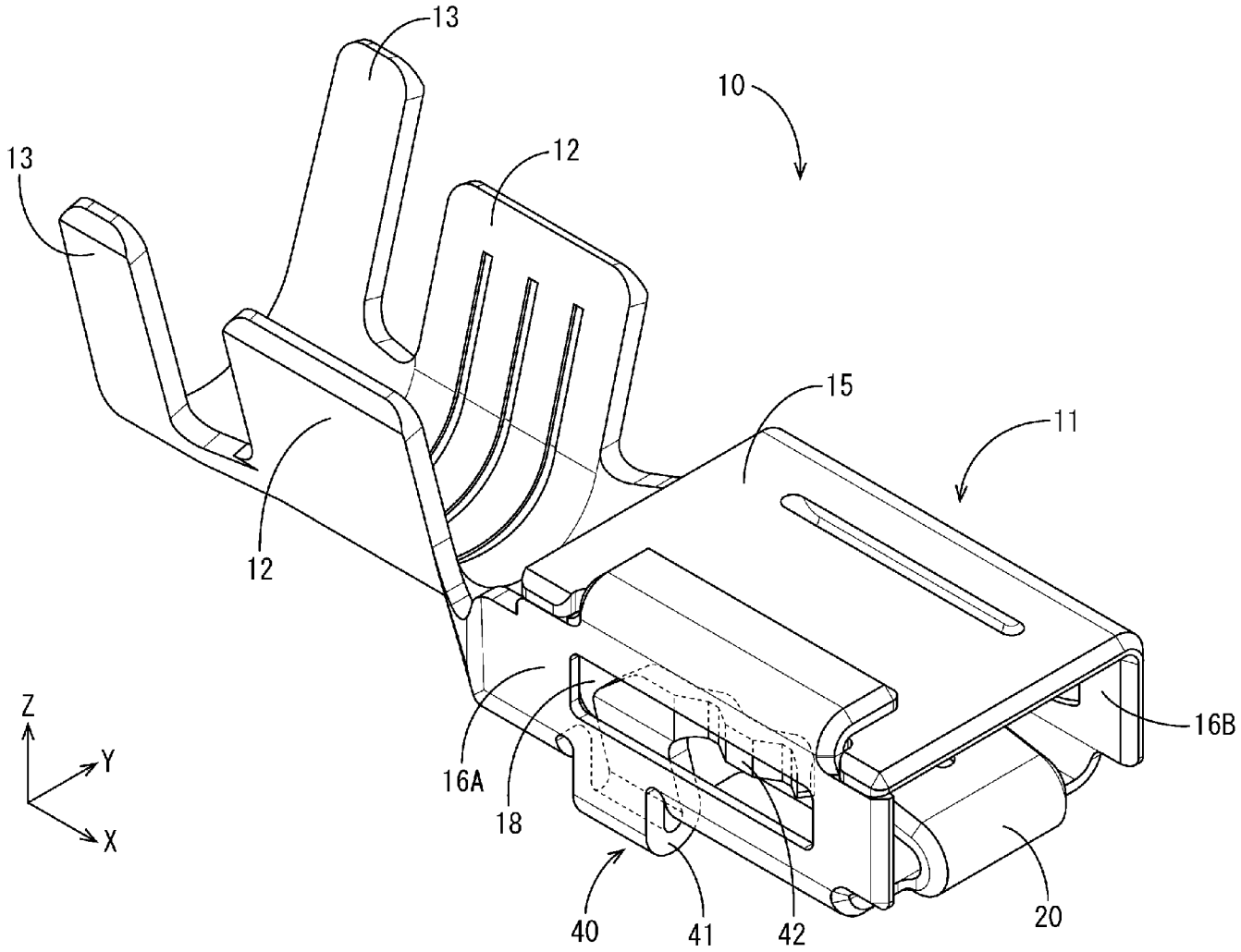
FIG. 1 is a perspective view of a female terminal according to a first embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The female terminal of the present disclosure is provided with a tubular connecting tube portion, a male terminal being connected to the connecting tube portion from front, a resilient contact piece configured to resiliently contact the male terminal inserted into the connecting tube portion from a first direction, a receiving portion configured to sandwich the male terminal between the resilient contact piece and the receiving portion inside the connecting tube portion, a vibration suppressing portion configured to resiliently contact the male terminal from a second direction intersecting the first direction, and a contact portion configured to sandwich the male terminal between the vibration suppressing portion and the contact portion inside the connecting tube portion, the vibration suppressing portion being provided on a wall portion constituting the connecting tube portion, the vibration suppressing portion including a plurality of deflecting portions deflectable in the second direction.

According to this configuration, since the male terminal is sandwiched in the second direction by the vibration suppressing portion and the contact portion when being inserted into the connecting tube portion, rattling in the second direction is suppressed. Thus, even if a connector using the above female terminal is used over a long period of time in a vibrating environment, it is possible to suppress the wear of the male terminal and a connection failure between the terminals due to the rattling in the second direction.

Further, since the vibration suppressing portion is provided with the plurality of deflecting portions in this configuration, a large amount of deflection displacement of the vibration suppressing portion in the second direction can be ensured and an insertion force of the male terminal can be reduced. Further, since the amount of deflection displacement is large, allowable dimensional tolerances of the male terminal and the female terminal can be ensured, which leads to an improvement in productivity.

(2) Preferably, the connecting tube portion includes a bottom wall, a ceiling wall facing the bottom wall and a pair of side walls rising from both side edges of the bottom wall, the resilient contact piece is provided on the bottom wall, and the vibration suppressing portion is provided on either one of the side wall and the ceiling wall.

Since the vibration suppressing portion is provided on either one of the side wall and the ceiling wall other than the bottom wall, the vibration suppressing portion needs not be provided to avoid the resilient contact piece.

(3) Further, a female connector of the present disclosure is provided with the above female terminal, a female housing including a female terminal accommodating portion, the female terminal being inserted into the female terminal accommodating portion, and a retainer, wherein the plurality of deflecting portions include an outer deflecting portion projecting outward of the connecting tube portion and an inner deflecting portion disposed inside the connecting tube portion, and the outer deflecting portion is disposed in front of the retainer inside the female terminal accommodating portion.

By this configuration, inverted insertion can be prevented when the female terminal is accommodated into the female housing.

Details of Embodiment of Present Disclosure

Hereinafter, embodiments of the present disclosure are described. The present disclosure is not limited to these illustrations and is intended to be represented by claims and include all changes in the scope of claims and in the meaning and scope of equivalents.

First Embodiment

A first embodiment of the present disclosure is described with reference to FIGS. 1 to 12. In the following embodiment, an X direction, a Y direction and Z direction in FIGS. 1 to 5 and 7 to 12 are referred to as a forward direction, a rightward direction and an upward direction.

[Female Connector, Female Housing, Retainer]

Figure 7:
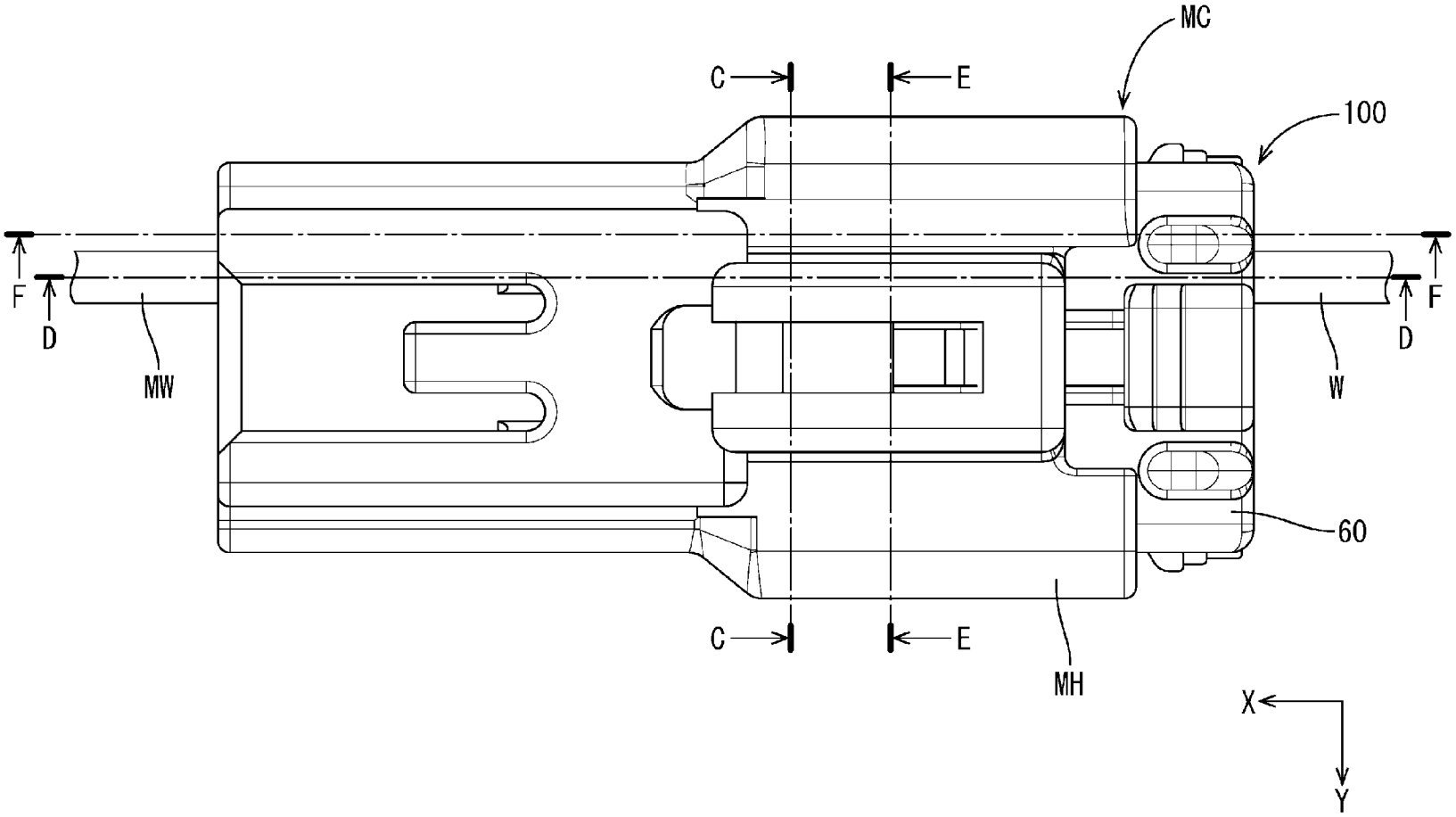
FIG. 7 is a plan view showing a state where a male connector and a female connector according to the first embodiment are connected.
Figure 12:
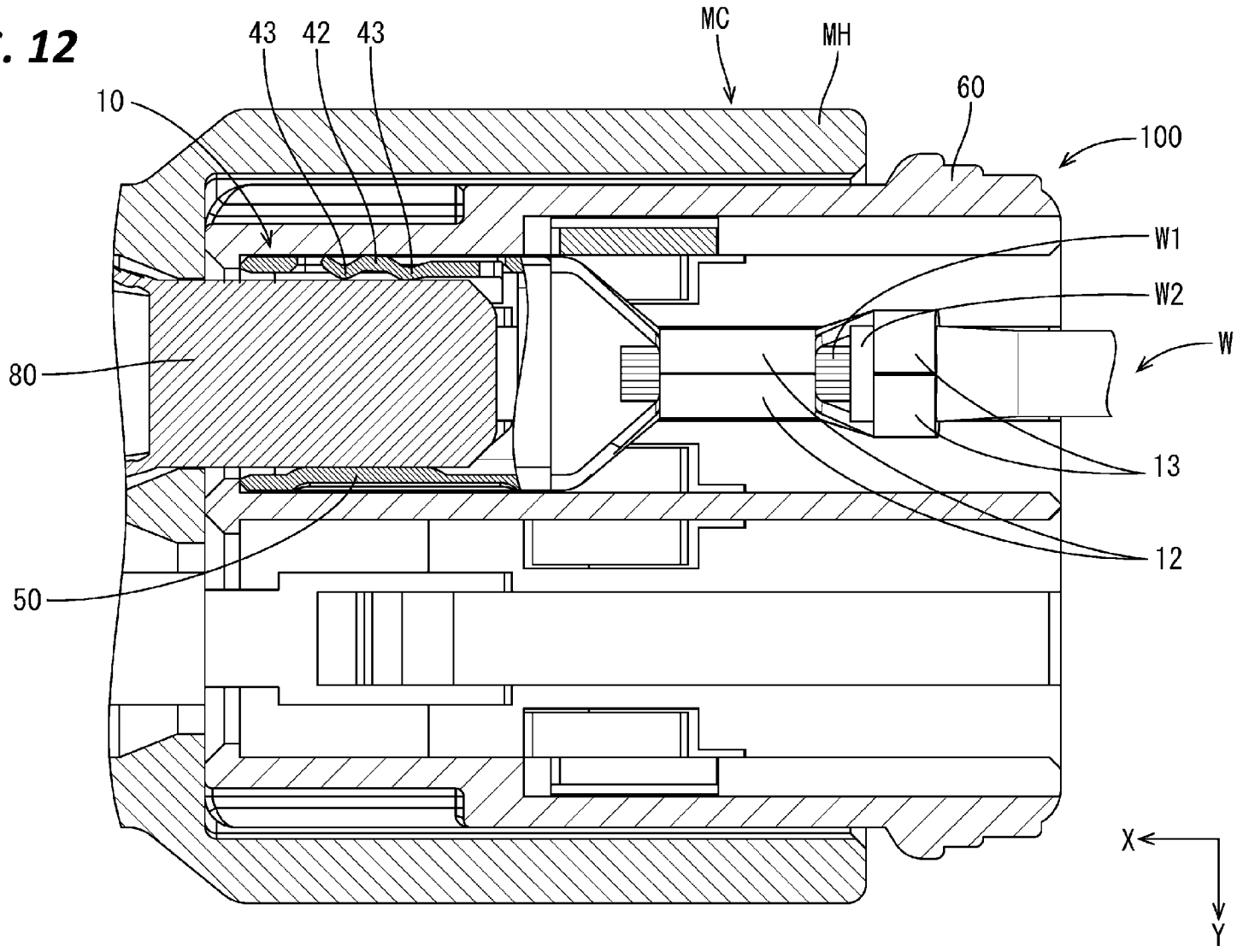
FIG. 12 is a section along G-G in FIG. 9.

A female connector 100 includes a female terminal 10 connected to a wire W, a female housing 60 and a retainer 70. A mating male connector MC of the female connector 100 includes a male terminal 80 connected to a wire MW and a male housing MH as shown in FIGS. 7 and 12. The male connector MC is fit to an outer peripheral side of the female connector 100. The female housing 60 and the male housing MH are made of synthetic resin.

[Female Terminal]

Figure 2:
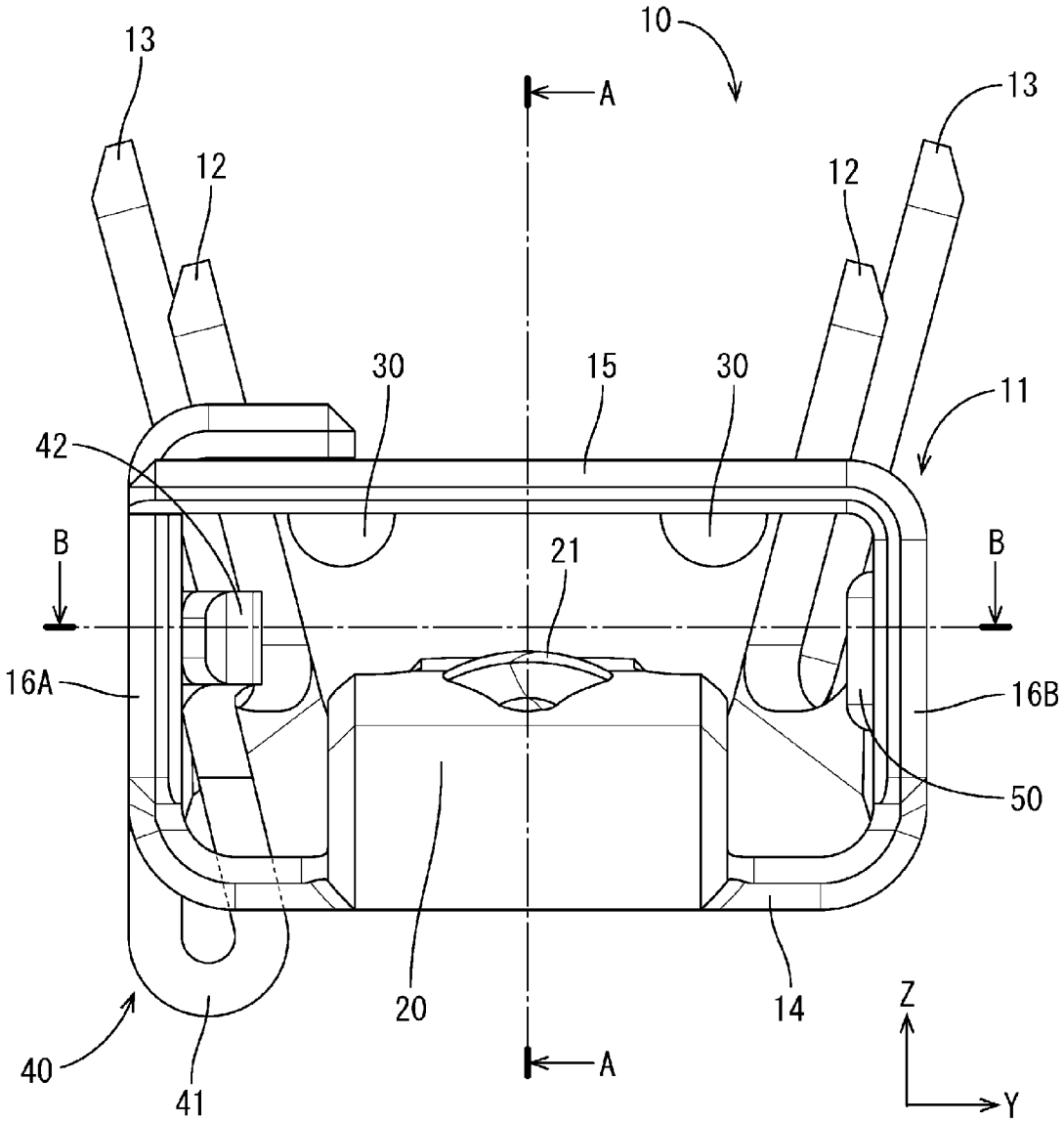
FIG. 2 is a front view of the female terminal according to the first embodiment.
Figure 3:
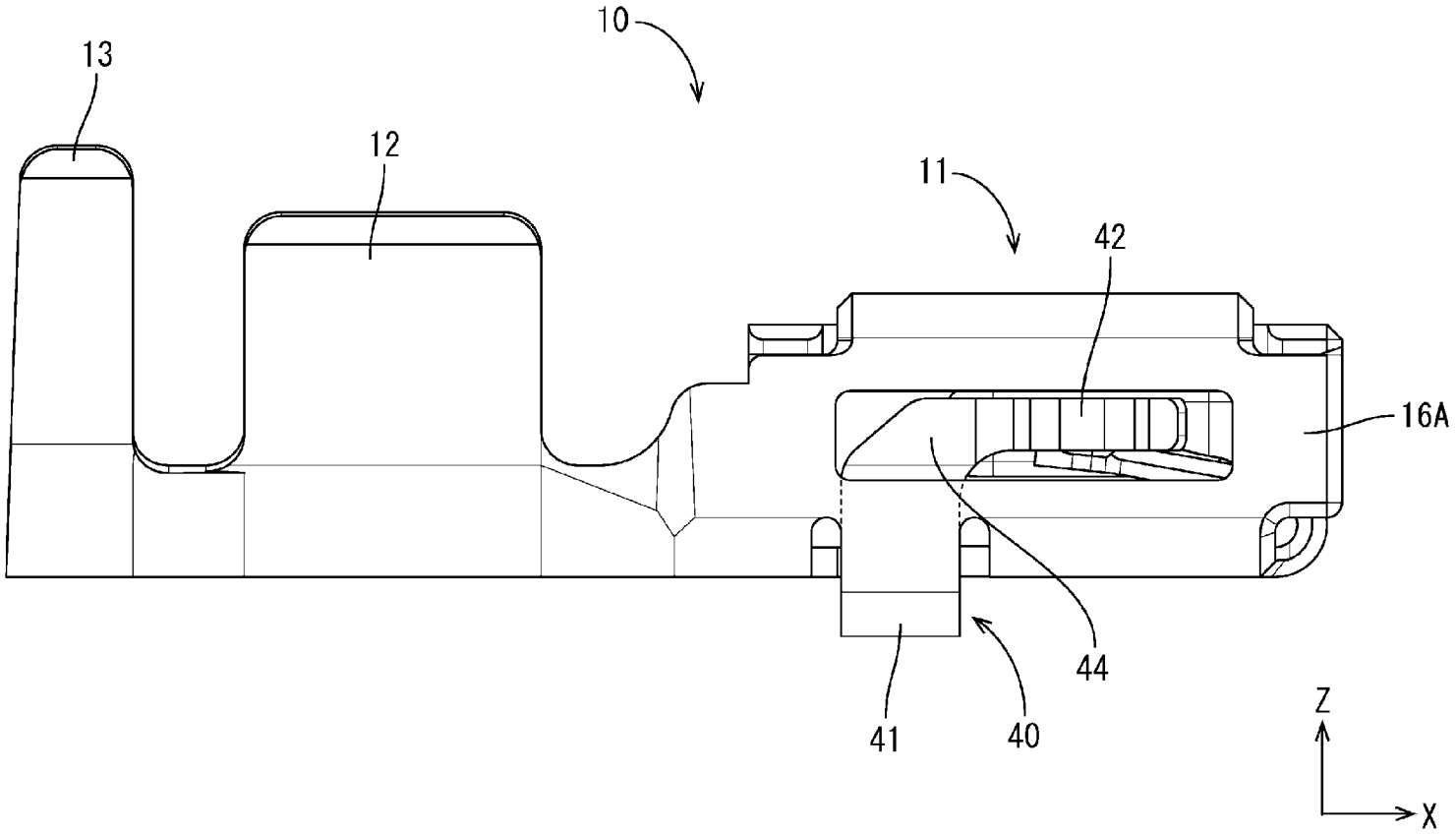
FIG. 3 is a side view of the female terminal according to the first embodiment.

The female terminal 10 according to the first embodiment is formed by press-working and bending a conductive metal plate. As shown in FIGS. 1 to 3, the female terminal 10 includes a tubular connecting tube portion 11 into which the mating male terminal 80 is inserted from front, and a wire barrel 12 and an insulation barrel 13 disposed behind the connecting tube portion 11. The wire W is configured such that a core W1 is covered by an insulation coating W2. As shown in FIG. 12, the wire barrel 12 is crimped to the core W1 on an end of the wire W to electrically connect the female terminal 10 and the wire W. The insulation barrel 13 is crimped to the insulation coating W2 of the wire W.

As shown in FIG. 2, the connecting tube portion 11 includes a bottom wall 14, a ceiling wall 15 facing the bottom wall 14 and a pair of side walls 16A, 16B rising from both side edges of the bottom wall 14. In FIG. 2, out of the pair of side walls 16A, 16B, the side wall 16A is disposed on a left side and the side wall 16B is disposed on a right side.

Figure 8:
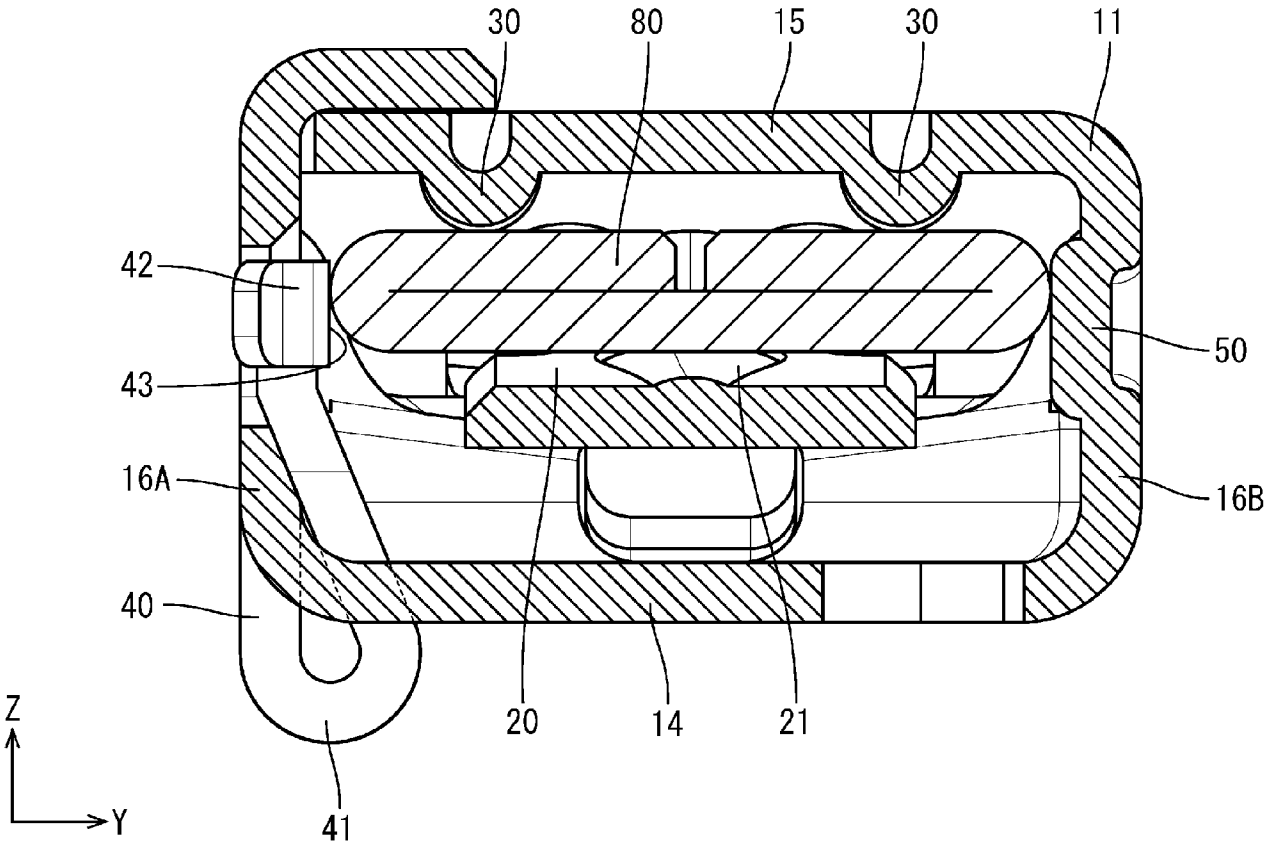
FIG. 8 is a section along C-C in FIG. 7 showing only a male terminal and the female terminal.

As shown in FIG. 2, a resilient contact piece 20 bent into the connecting tube portion 11 is provided on the front edge of the bottom wall 14. The resilient contact piece 20 is deflectable in a vertical direction and a contact point 21 is provided on the upper surface of the resilient contact piece 20. The contact point 21 is formed to project upward. As shown in FIG. 8, with the male terminal 80 inserted in the connecting tube portion 11, the contact point 21 is in contact with the lower surface of the male terminal 80.

As shown in FIG. 2, the ceiling wall 15 is provided with rib-like receiving portions 30 projecting downward. The receiving portions 30 are disposed to sandwich the male terminal 80 between the contact point 21 and the receiving portions 30 with the male terminal 80 inserted in the connecting tube portion 11 as shown in FIG. 8. In this way, the male terminal 80 and the resilient contact piece 20 are electrically connected.

Figure 5:
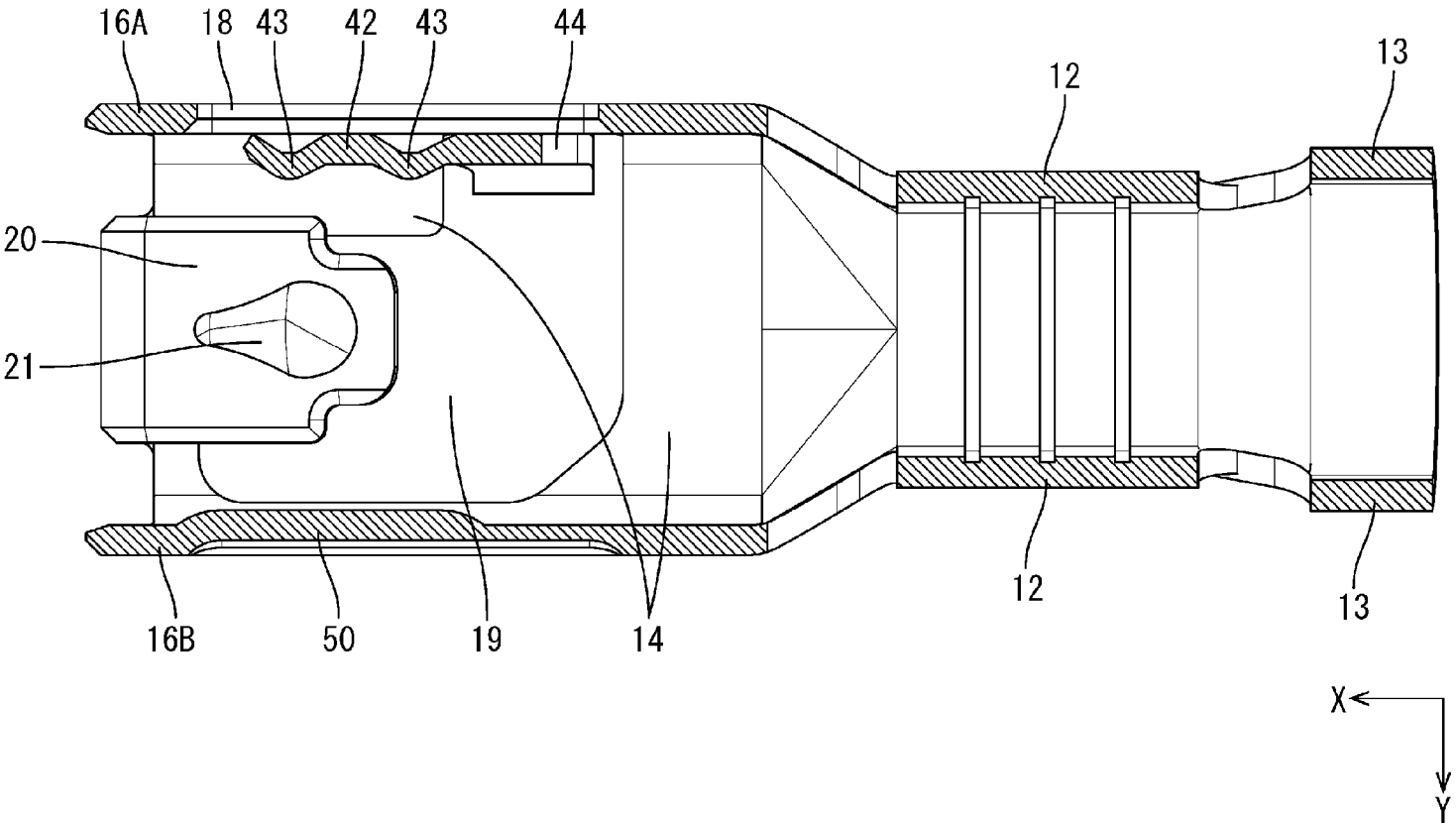
FIG. 5 is a section along B-B in FIG. 2.
Figure 6:
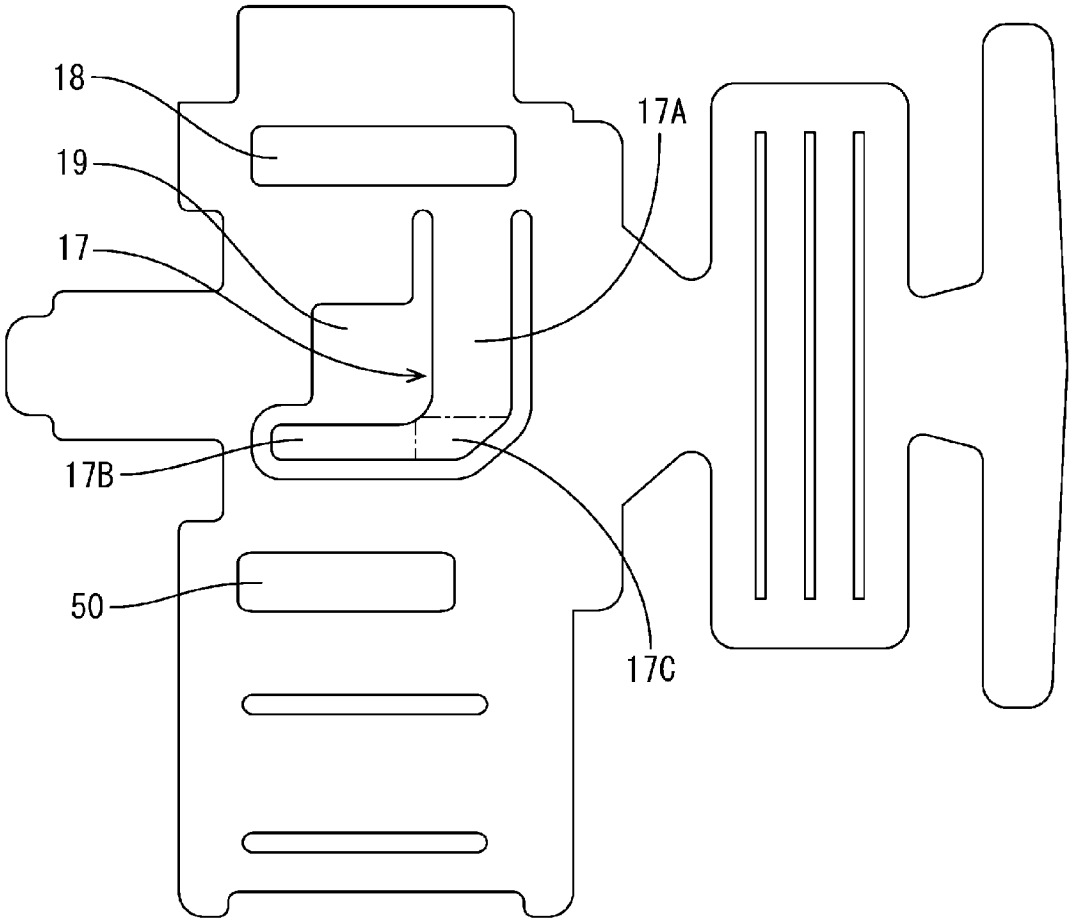
FIG. 6 is a development of the female terminal according to the first embodiment.

As shown in FIG. 2, the side wall 16B is provided with a rib-like contact portion 50 projecting leftward. As shown in FIGS. 5 and 6, the contact portion 50 has a rectangular shape long in a front-rear direction and short in the vertical direction.

Figure 4:
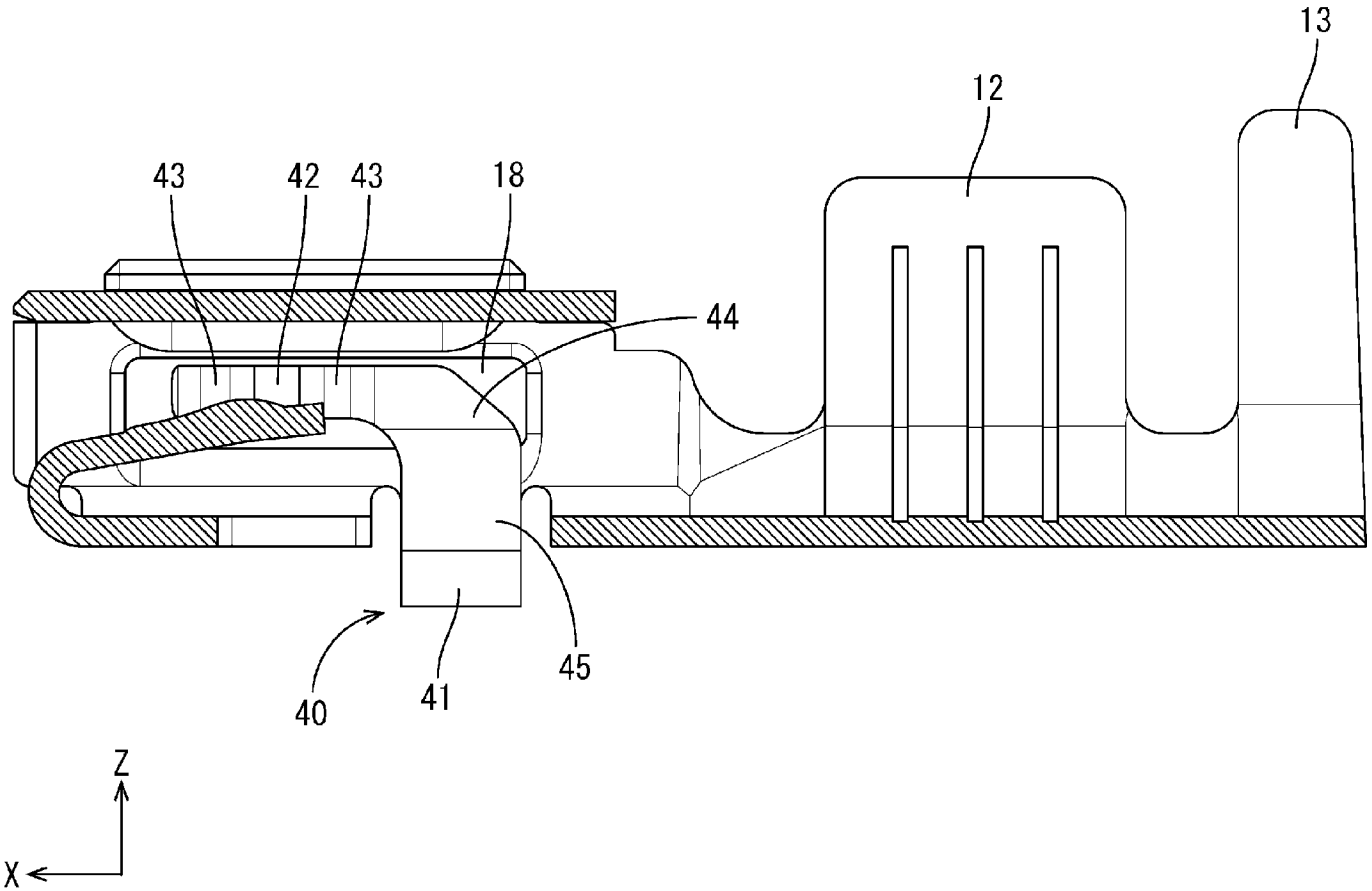
FIG. 4 is a section along A-A in FIG. 2.

As shown in FIGS. 1 to 4, a cantilevered vibration suppressing portion 40 is provided on a lower edge part of the side wall 16A. As shown in FIG. 4, the vibration suppressing portion 40 is composed of an outer deflecting portion 41, an inner deflecting portion 42, supporting portions 43, a corner portion 44 and an extending portion 45.

In a state of development shown in FIG. 6, a part corresponding to the vibration suppressing portion 40 is an L-shaped resilient piece 17. In the resilient piece 17, a wide portion 17A on a base end side is connected to a narrow portion 17B on a tip side via a corner portion 17C (broken lines of FIG. 6 indicate boundaries). The narrow portion 17B is formed to extend in the front-rear direction. The wide portion 17A is formed to extend in a width direction orthogonal to the front-rear direction.

In a finished state of the female terminal 10, the narrow portion 17A is bent into the connecting tube portion 11 and projects downward of the bottom wall 14 as shown in FIGS. 1 to 4. This projecting part serves as the outer deflecting portion 41. As shown in FIGS. 1 to 5, the narrow portion 17B is made uneven by press-working and disposed near the side wall 16A in the finished state of the female terminal 10. This uneven part serves as the inner deflecting portion 42. As shown in FIG. 5, the inner deflecting portion 42 includes a pair of the supporting portions 43 projecting inward of the connecting tube portion 11. The corner portion 17C is disposed along the side wall 16A together with the inner deflecting portion 42 as shown in FIGS. 3 to 5 in the finished state of the female terminal 10 and serves as the corner portion 44. As shown in FIG. 4, the corner portion 44 is connected to the outer deflecting portion 41 via the extending portion 45.

The outer and inner deflecting portions 41, 42 are both deflectable in a lateral direction. As shown in FIGS. 1 and 4, the side wall 16A is formed with a through hole 18 to allow a resilient displacement of the inner deflecting portion 42 in the leftward direction, i.e. in a direction toward the side wall 16A.

With the male terminal 80 inserted in the connecting tube portion 11, the male terminal 80 is laterally sandwiched by the pair of supporting portions 43 and the contact portion 50 as shown in FIGS. 8 and 12. At this time, the vibration suppressing portion 40 is displaced leftward as compared to a natural state. Since the vibration suppressing portion 40 includes the deflecting portions at two positions, a large amount of deflection displacement can be set as compared to the case where a deflecting portion is provided at one position.

[Female Housing]

Figure 9:
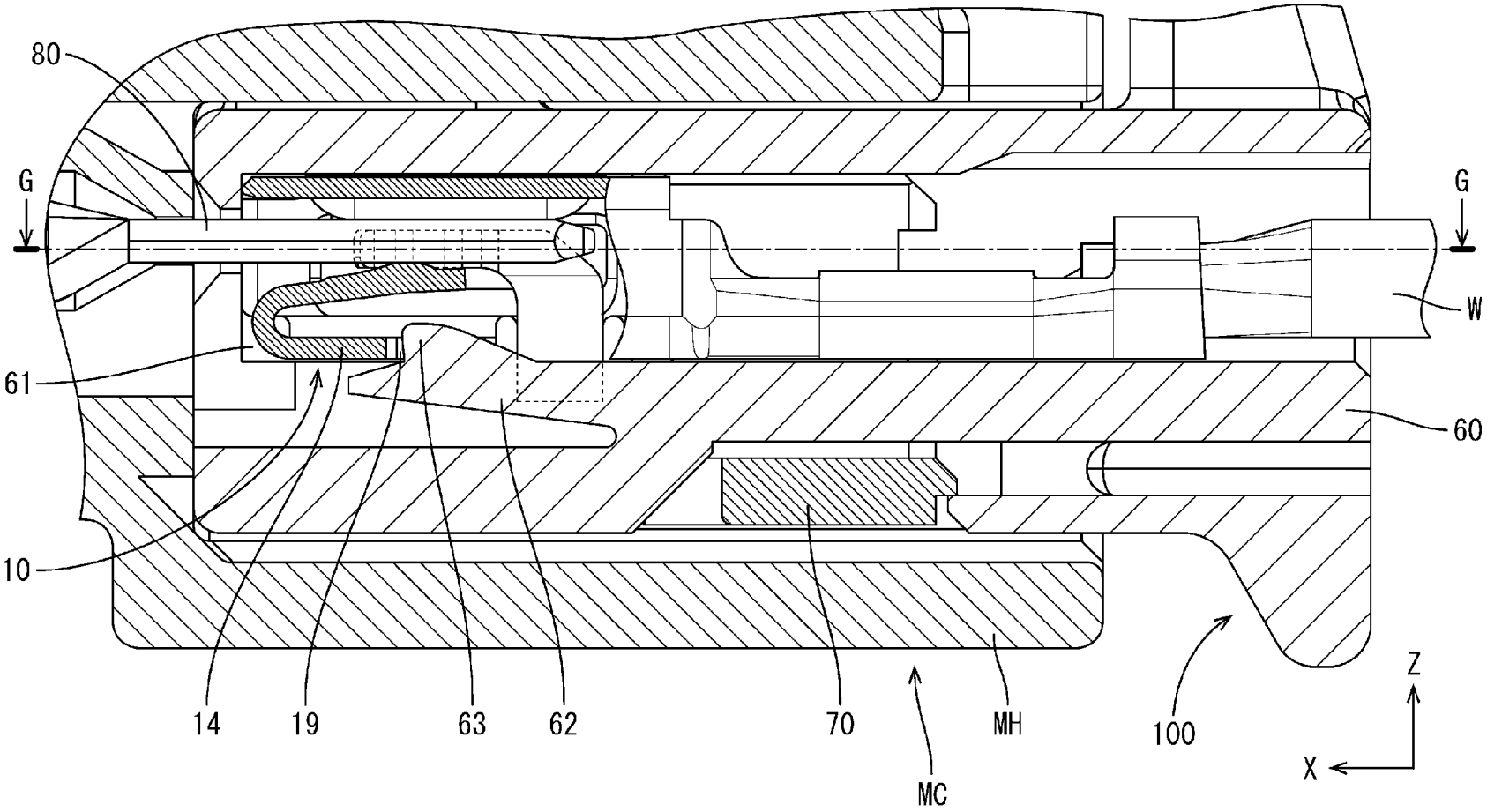
FIG. 9 is a section along D-D in FIG. 7 enlargedly showing the periphery of the female terminal.
Figure 10:
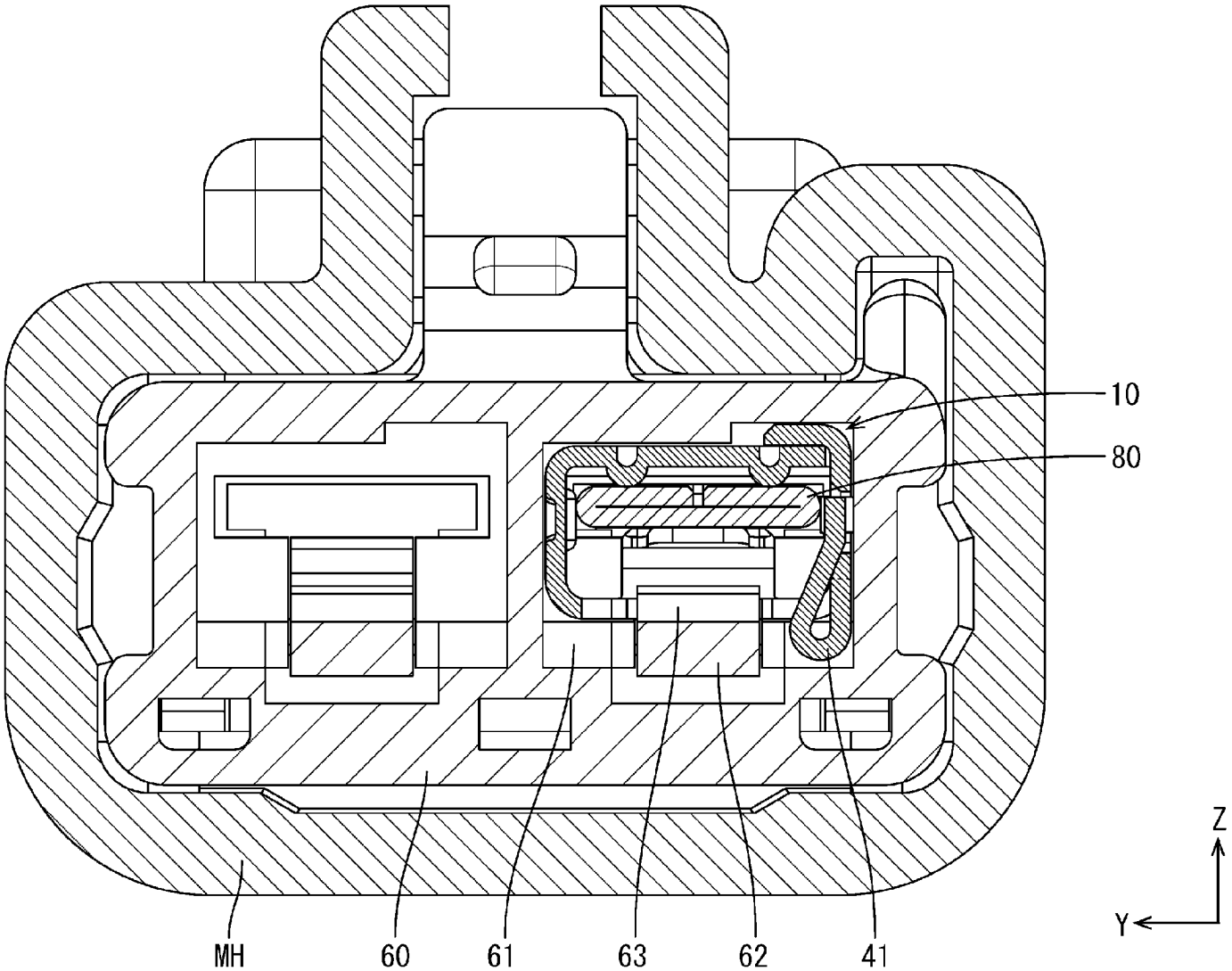
FIG. 10 is a section along E-E of FIG. 7.
Figure 11:
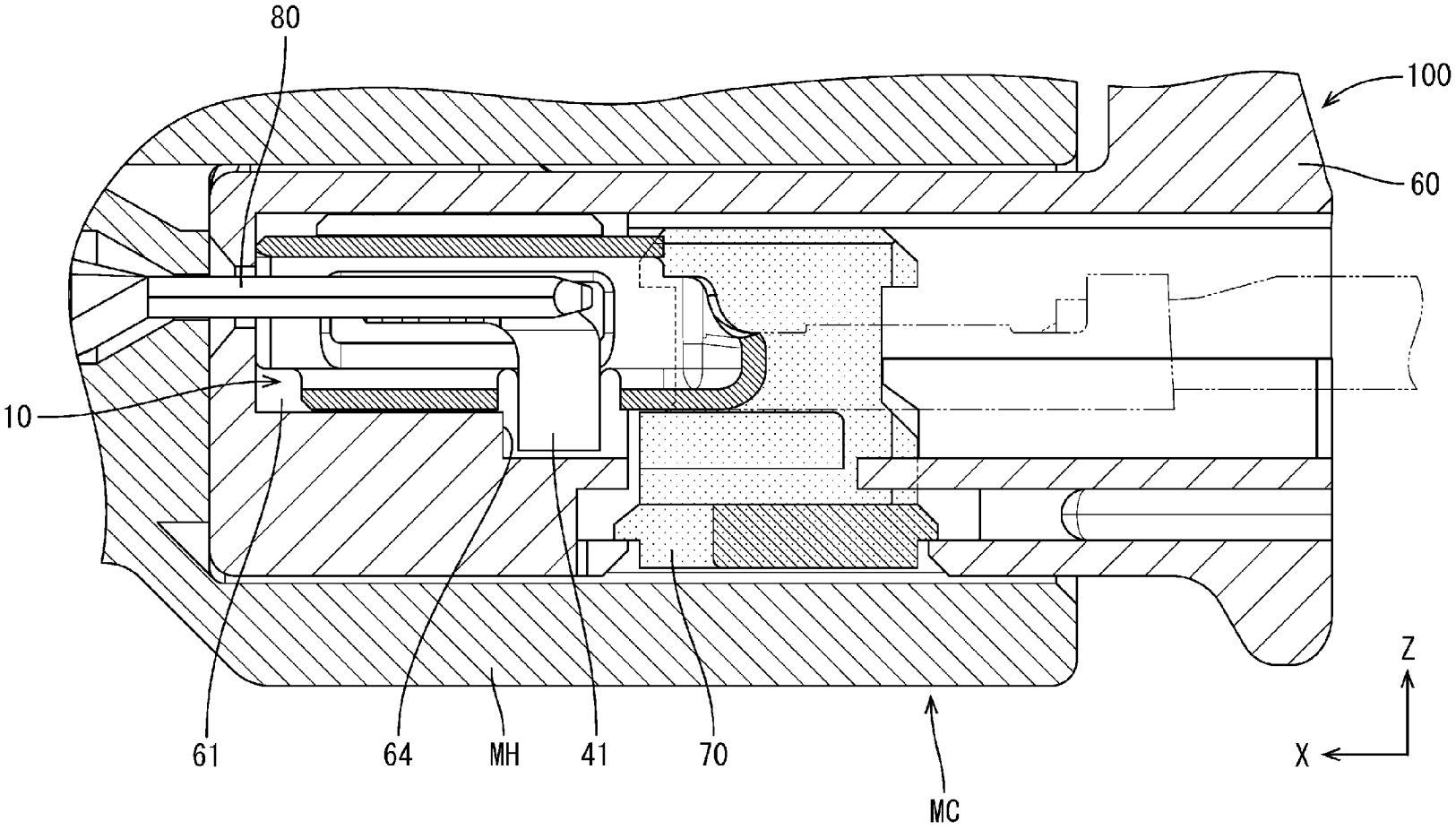
FIG. 11 is a section along F-F in FIG. 7 enlargedly showing the periphery of the female terminal.

As shown in FIGS. 9 to 11, the female housing 60 includes female terminal accommodating portions 61 for accommodating the female terminals 10 connected to the wires W and locking lances 62. The locking lance 62 is disposed in a lateral center of the lower surface of the female terminal accommodating portion 61. The locking lance 62 is cantilevered forward and flexible. A female terminal locking portion 63 projecting upward is provided on the upper surface of the locking lance 62.

As shown in FIG. 9, when the female terminal 10 is accommodated into the female terminal accommodating portion 61, the locking lance 62 is deflected downward and the female terminal 10 is accommodated. At this time, the female terminal locking portion 63 of the locking lance 62 is accommodated into a locking hole 19 (see FIGS. 5 and 6) provided in the bottom wall 14 of the female terminal 10. An inner wall of the locking hole 19 is locked from behind by the female terminal locking portion 63, whereby the rearward escape of the female terminal 10 is suppressed.

As shown in FIG. 10, grooves are provided to the left and right of the locking lance 62 in the lower surface of the female terminal accommodating portion 61. A front wall 64 is provided forward of those grooves as shown in FIG. 11. On the other hand, no groove like those provided in the lower surface is provided in the upper surface of the female terminal accommodating portion 61.

The outer deflecting portion 41 projecting downward from the connecting tube portion 11 with the female terminal 10 accommodated in the female terminal accommodating portion 61 is accommodated in the groove of the lower surface of the female terminal accommodating portion 61 as shown in FIG. 10. At this time, the retainer 70 is disposed behind the outer deflecting portion 41 as shown in FIG. 11. This causes the outer deflecting portion 41 to be locked by the retainer 70 even if the wire W is pulled rearward to break the locking lance 62, whereby the rearward escape of the female terminal 10 is suppressed. Further, since no groove capable of accommodating the outer deflecting portion 41 is provided in the upper surface of the female terminal accommodating portion 61, the vertically inverted insertion of the female terminal 10 into the female housing 60 is prevented. Such a part functioning to prevent the rearward escape of the female terminal 10 and prevent the inverted insertion into the female housing 60 is generally a stabilizer. That is, the outer deflecting portion 41 doubles as a stabilizer in this embodiment.

[Functions and Effects of Embodiment]

According to this embodiment, the following functions and effects are achieved. The female terminal 10 according to this embodiment includes the tubular connecting tube portion 11, the male terminal 80 being connected to the connecting tube portion 11 from front, the resilient contact piece 20 configured to resiliently contact the male terminal 80 inserted into the connecting tube portion 11 from a first direction, the receiving portions 30 configured to sandwich the male terminal 80 between the resilient contact piece 20 and the receiving portions 30 inside the connecting tube portion 11, the vibration suppressing portion 40 configured to resiliently contact the male terminal 80 from a second direction intersecting the first direction, and the contact portion 50 configured to sandwich the male terminal 80 between the vibration suppressing portion 40 and the contact portion 50 inside the connecting tube portion 11, and the vibration suppressing portion 40 is provided on a wall portion constituting the connecting tube portion 11 and includes a plurality of deflecting portions deflectable in the second direction.

According to this configuration, since the male terminal 80 is sandwiched in the second direction by the vibration suppressing portion 40 and the contact portion 50 when being inserted into the connecting tube portion 11, rattling in the second direction is suppressed. Thus, even if the connector using the above female terminal 10 is used over a long period of time in a vibrating environment, it is possible to suppress the wear of the male terminal 80 and a connection failure between the terminals due to the rattling in the second direction.

Further, since the vibration suppressing portion 40 includes the plurality of deflecting portions in this configuration, a large amount of deflection displacement of the vibration suppressing portion 40 in the second direction can be ensured and an insertion force of the male terminal 80 can be reduced as compared to the case where a deflecting portion is provided at one position. Further, since the amount of deflection displacement is large, allowable dimensional tolerances of the male terminal 80 and the female terminal 10 can be ensured, which leads to an improvement in productivity.

According to this embodiment, the connecting tube portion 11 includes the bottom wall 14, the ceiling wall 15 facing the bottom wall 14 and the pair of side walls 16A, 16B rising from the both side edges of the bottom wall 14, the resilient contact piece 20 is provided on the bottom wall 14, and the vibration suppressing portion 40 is provided on the side wall 16A.

Since the vibration suppressing portion 40 is provided on the side wall 16A other than the bottom wall 14, the vibration suppressing portion 40 needs not be provided to avoid the resilient contact piece 20.

Further, the female connector 100 of the present disclosure includes the above female terminal 10, the female housing 60 including the female terminal accommodating portion 61 into which the female terminal 10 is inserted, and the retainer 70, the plurality of deflecting portions include the outer deflecting portion 41 projecting outward of the connecting tube portion 11 from the bottom wall 14 and the inner deflecting portion 42 disposed inside the connecting tube portion 11, and the outer deflecting portion 41 is disposed in front of the retainer 70 inside the female terminal accommodating portion 61.

By this configuration, inverted insertion can be prevented when the female terminal 10 is accommodated into the female housing 60.

Second Embodiment

A second embodiment is described with reference to FIGS. 13 to 18. In the following embodiment, an X direction, a Y direction and Z direction in FIGS. 13 to 17 are referred to as a forward direction, a rightward direction and an upward direction. Note that the same components as in the first embodiment are not described and are denoted by the same reference signs as in the first embodiment.

[Female Terminal]

Figure 14:
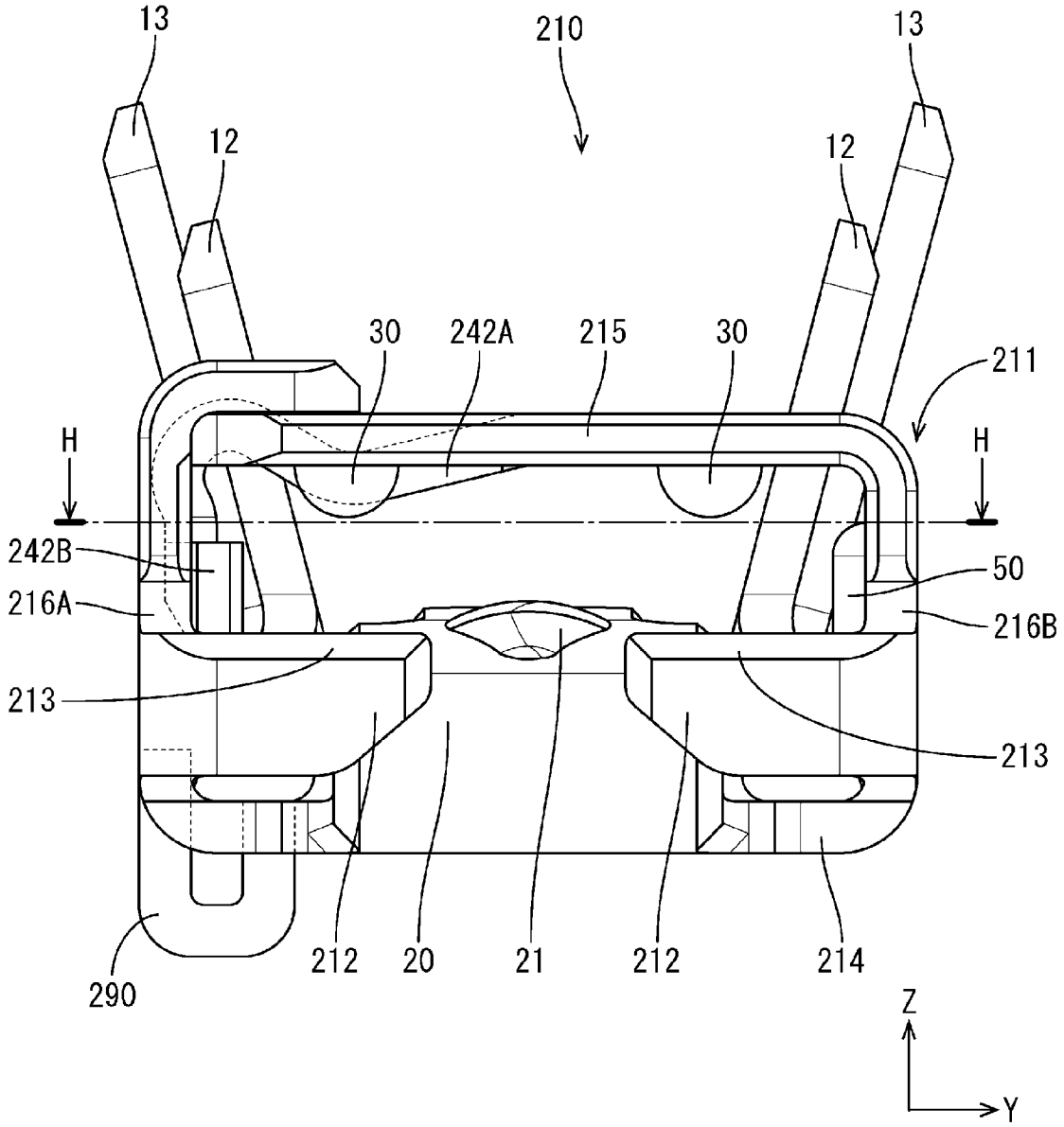
FIG. 14 is a front view of the female terminal according to the second embodiment.

A female terminal 210 of the second embodiment includes a tubular connecting tube portion 211 to which a mating male terminal 80 is connected from front. As shown in FIG. 14, the connecting tube portion 211 includes a bottom wall 214, a ceiling wall 215 facing the bottom wall 214 and a pair of side walls 216A, 216B rising from both side edges of the bottom wall 214. In FIG. 14, out of the pair of side walls 216A, 216B, the side wall 216A is disposed on a left side and the side wall 216B is disposed on a right side.

Figure 13:
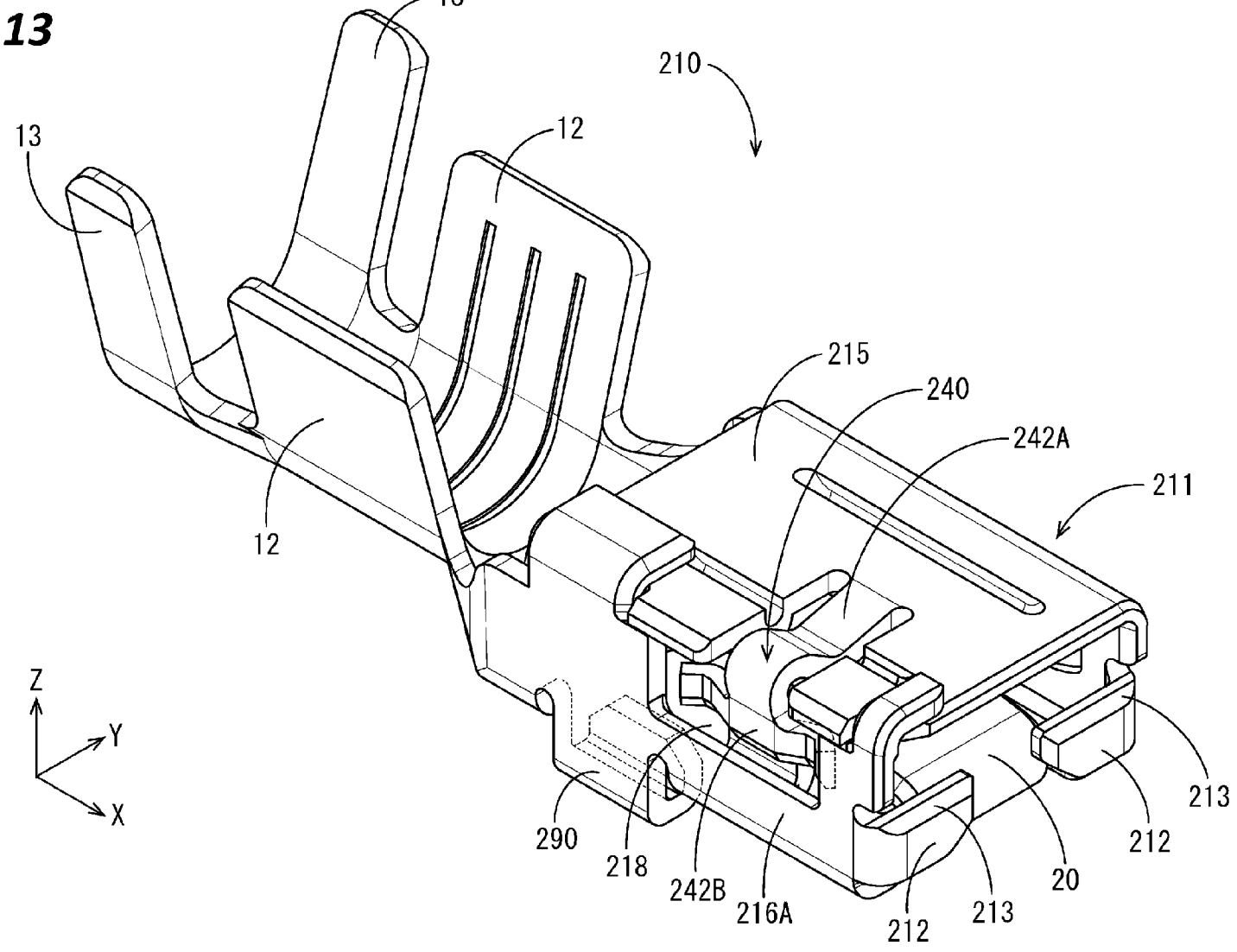
FIG. 13 is a perspective view of a female terminal according to a second embodiment.
Figure 15:
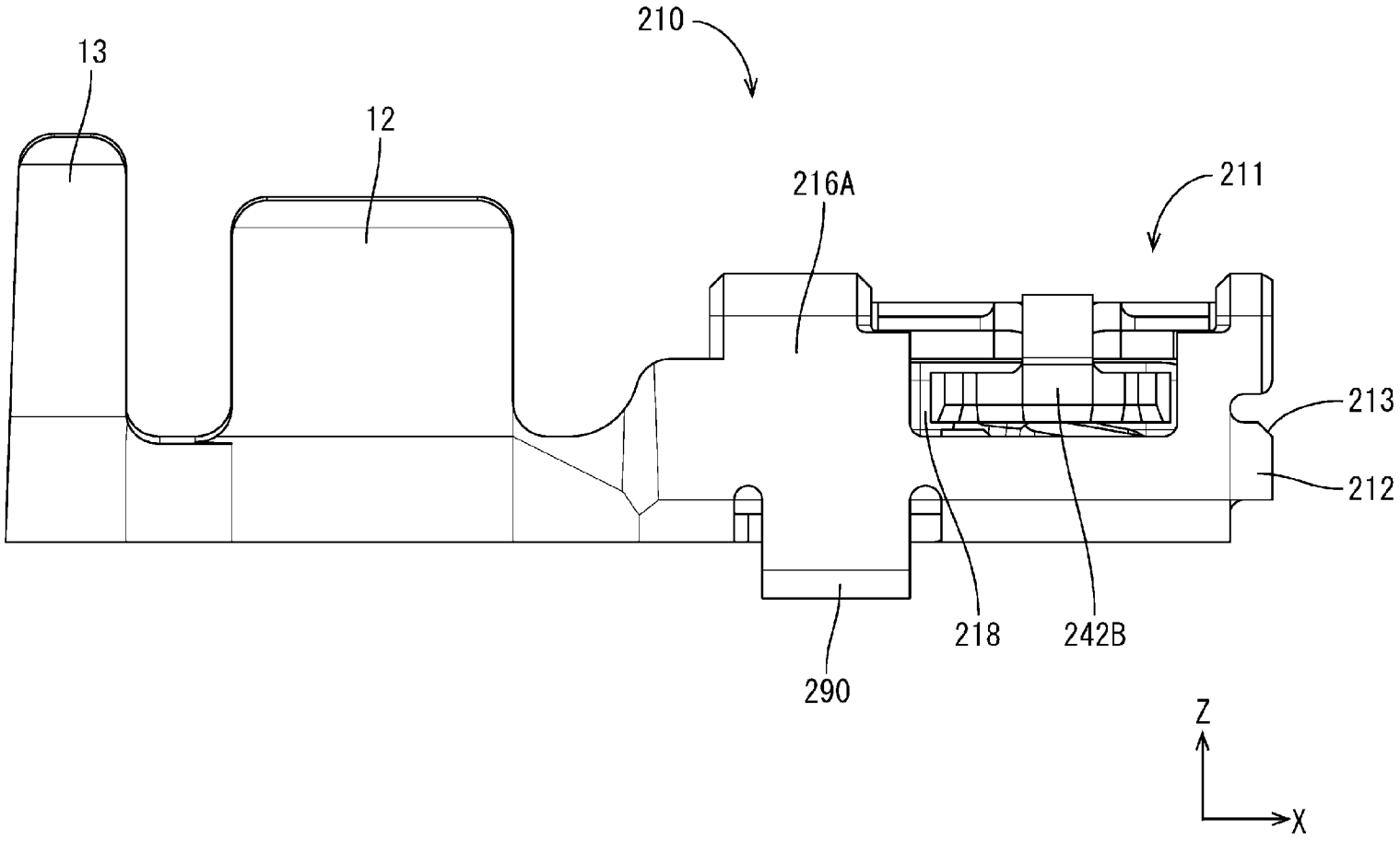
FIG. 15 is a side view of the female terminal according to the second embodiment.

As shown in FIGS. 13 and 14, the female terminal 210 includes a pair of protection walls 212 on front edge parts of side walls of the connecting tube portion 211. In a state of development shown in FIG. 18, parts corresponding to the protection walls 212 are projecting end portions 230. The protection wall 212 provided on the side wall 216A projects toward the front edge of the side wall 216B, and the protection wall 212 provided on the side wall 216B projects toward the front edge of the side wall 216A. Thus, the tips of the pair of protection walls 212 are arranged to face each other. An interval between the tips of the protection walls 212 is smaller than a lateral width of the male terminal 80. As shown in FIG. 14, the upper ends of the protection walls 212 are arranged to be slightly lower than a height position of a contact point 21 on the upper surface of a resilient contact piece 20. By this configuration, when being inserted into the connecting tube portion 211, the male terminal 80 is prevented from contacting a base end part of the resilient contact piece 20 and guided to contact the contact point 21 on the upper surface of the resilient contact piece 20. As shown in FIGS. 13 and 15, tapered structures 213 having a height increasing from a front side toward a rear side are provided on upper edge parts of the protection walls 212. The male terminal 80 is smoothly guided into the connecting tube portion 211 by these tapered structures 213.

Figure 17:
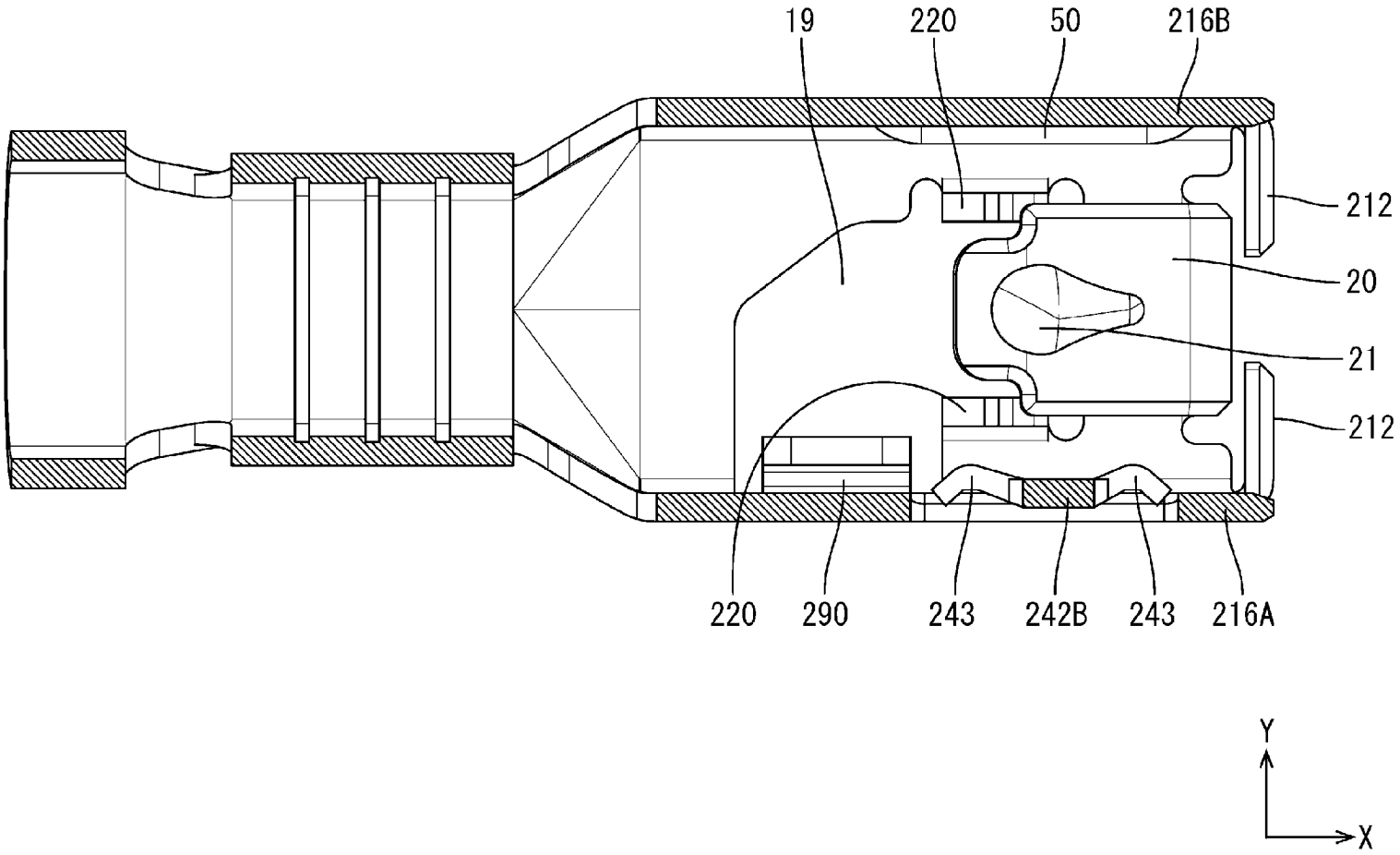
FIG. 17 is a section along H-H in FIG. 14.

As shown in FIG. 17, the bottom wall 214 is provided with a pair of excessive deflection preventing portions 220 on both left and right sides of a rear end part of the resilient contact piece 20. In the state of development shown in FIG. 18, parts corresponding to the excessive deflection preventing portions 220 are cut pieces 221. The excessive deflection preventing portions 220 are arranged to come into contact with the rear end part of the resilient contact piece 20 from below if the resilient contact piece 20 is excessively deflected downward. In this way, the downward excessive deflection of the resilient contact piece 20 is limited and the plastic deformation of the resilient contact piece 20 can be avoided.

Figure 16:
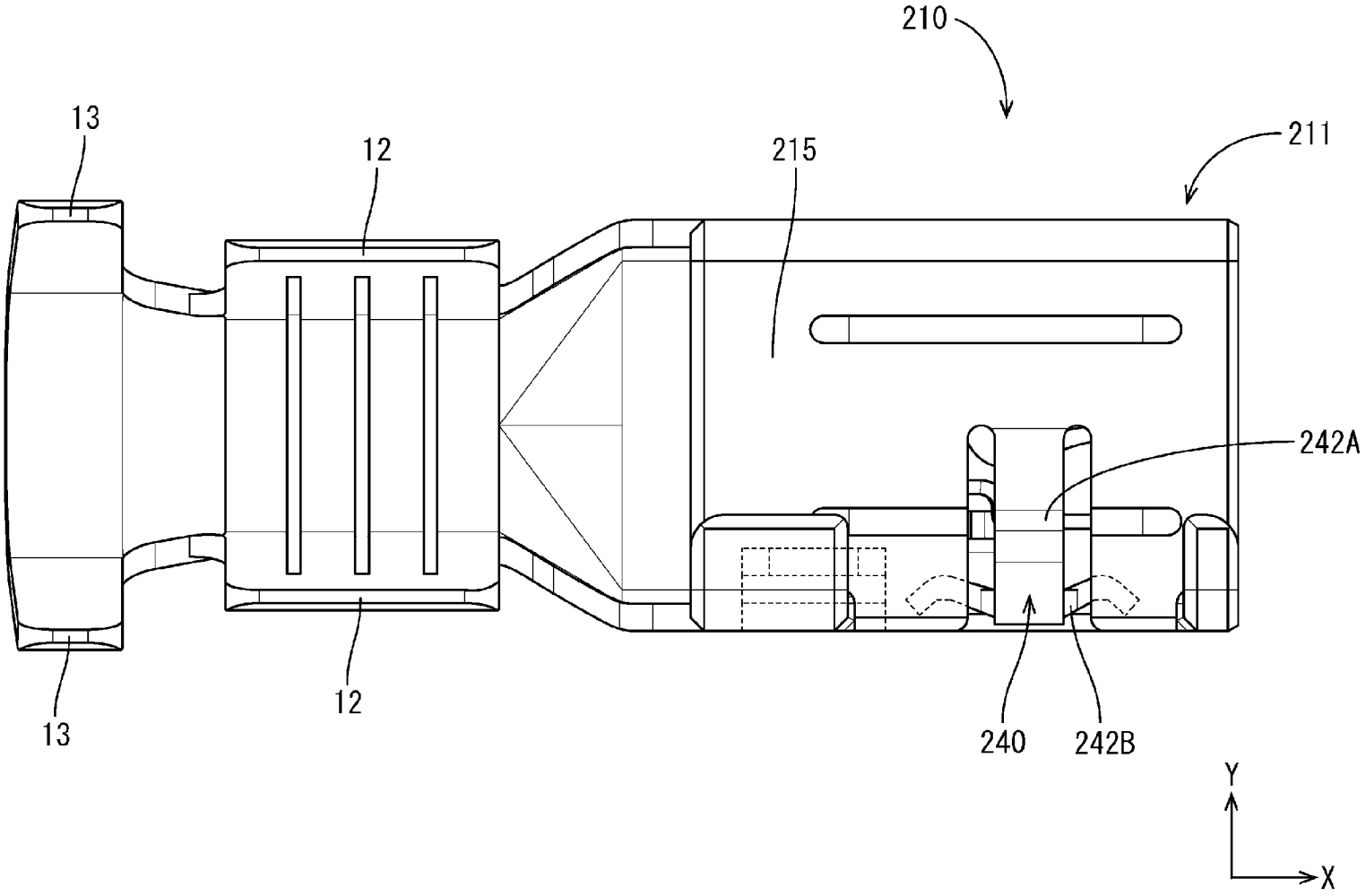
FIG. 16 is a plan view of the female terminal according to the second embodiment.

As shown in FIGS. 13 and 16, the ceiling wall 215 is provided with a vibration suppressing portion 240. The vibration suppressing portion 240 includes inner deflecting portions 242A, 242B at two positions.

As shown in FIGS. 13 and 14, the female terminal 210 includes a stabilizer 290 instead of the outer deflecting portion 41 of the first embodiment. In this way, the inverted insertion of the female terminal 210 into a female housing 60 is prevented and the rearward escape of the female terminal 210 from the female housing 60 is suppressed.

Figure 18:
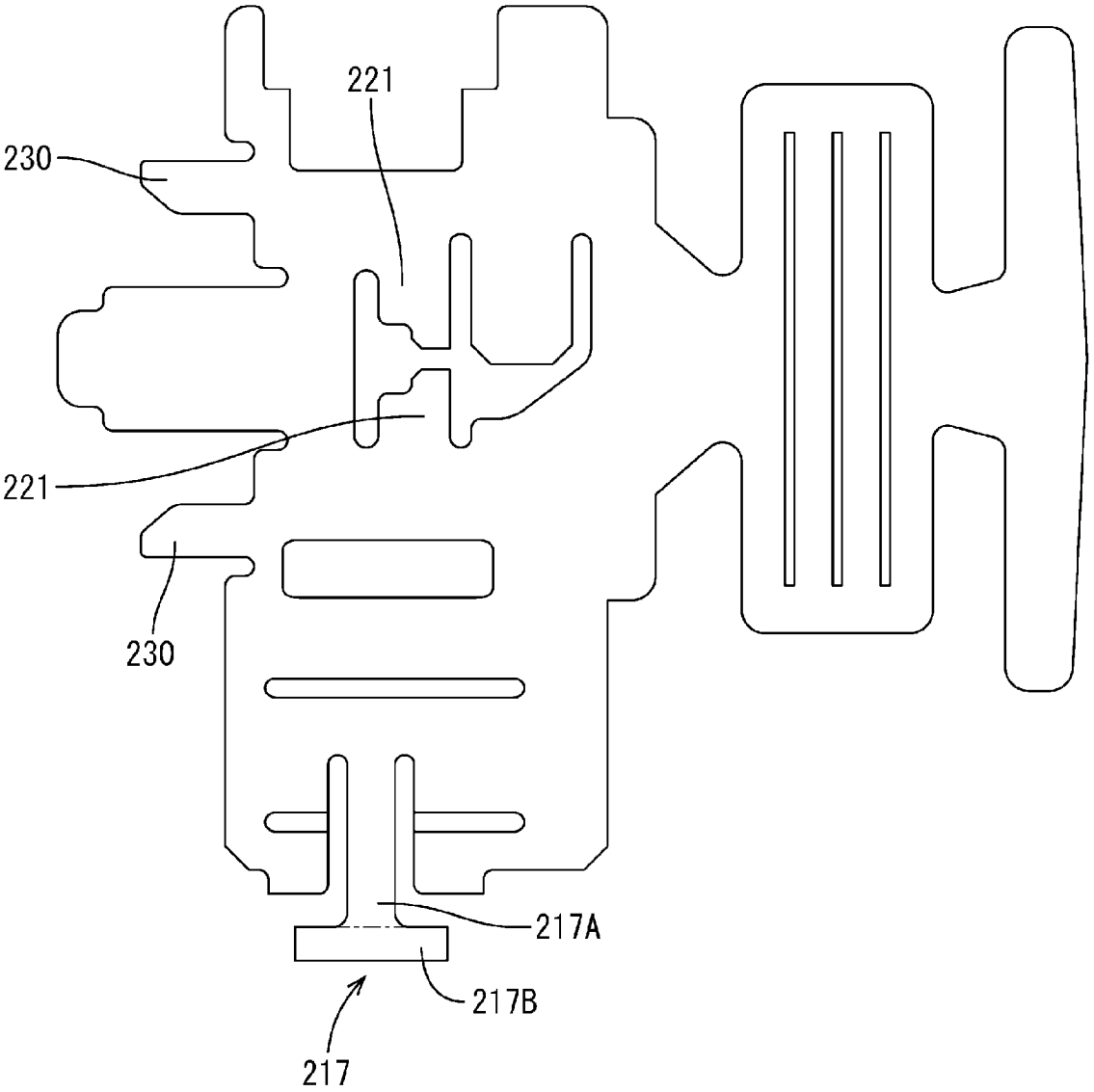
FIG. 18 is a development of the female terminal according to the second embodiment.

In the state of development shown in FIG. 18, a part corresponding to the vibration suppressing portion 240 is a T-shaped resilient piece 217. The resilient piece 217 includes a wide portion 217A on a base end side and a narrow portion 217B on a tip side (broken line of FIG. 18 indicates a boundary). The narrow portion 217B is formed to extend in a front-rear direction. The wide portion 217A is formed to extend in a width direction orthogonal to the front-rear direction. The wide portion 217A is connected to a central part in the front-rear direction of the narrow portion 217B on the tip side.

As shown in FIGS. 13, 14 and 16, the wide portion 217A is bent into the connecting tube portion 211 and serves as the inner deflecting portion 242A in a finished state of the female terminal 210. As shown in FIG. 14, the lower end of the inner deflecting portion 242A does not project further downward than the receiving portion 30 and does not contact the male terminal 80. As shown in FIGS. 13 and 17, the narrow portion 217B is made uneven by press-working and disposed near the side wall 216A in the finished state of the female terminal 210. This uneven part serves as the inner deflecting portion 242B. As shown in FIG. 17, the inner deflecting portion 242B includes a pair of supporting portions 243 projecting into the connecting tube portion 211. The supporting portions 243 laterally sandwich the male terminal 80 between the contact portion 50 and the supporting portions 243 with the male terminal 80 inserted in the connecting tube portion 211.

The inner deflecting portions 242A, 242B are both deflectable in a lateral direction. As shown in FIGS. 13 and 15, the side wall 216A is formed with a through hole 218 to allow a resilient displacement of the inner deflecting portion 242B in the leftward direction, i.e. in a direction toward the side wall 216A.

[Functions and Effects of Embodiment]

Since functions and effects of the second embodiment are similar to those of the first embodiment, repeated description is omitted.

Other Embodiments (1) Although the vibration suppressing portion 40, 240 includes the deflecting portions at two positions in the first and second embodiments, there is no limitation to this. A vibration suppressing portion may include deflecting portions at three or more positions.

(2) Although the resilient contact piece 20 is provided on the bottom wall 14, 214 in the first and second embodiments, there is no limitation to this. A resilient contact piece may be provided on a ceiling wall or a side wall.

(3) Although the vibration suppressing portion 40 is provided on the side wall 16A in the first embodiment and the vibration suppressing portion 240 is provided on the ceiling wall 215 in the second embodiment, there is no limitation to these. A vibration suppressing portion may be provided on a bottom wall.

(4) Although the protection walls 212 and the excessive deflection preventing portions 220 are provided in the second embodiment, there is no limitation to this. No protection wall or no excessive deflection preventing portion may be provided.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A female terminal, comprising:

a tubular connecting tube portion, a male terminal being connected to the connecting tube portion from front;

a resilient contact piece configured to resiliently contact the male terminal inserted into the connecting tube portion from a first direction;

a receiving portion configured to sandwich the male terminal between the resilient contact piece and the receiving portion inside the connecting tube portion;

a vibration suppressing portion configured to resiliently contact the male terminal from a second direction intersecting the first direction; and a contact portion configured to sandwich the male terminal between the vibration suppressing portion and the contact portion inside the connecting tube portion, wherein the vibration suppressing portion being provided on a wall portion constituting the connecting tube portion, the vibration suppressing portion including a plurality of deflecting portions deflectable in the second direction.

2. The female terminal of claim 1, wherein:

the connecting tube portion includes a bottom wall, a ceiling wall facing the bottom wall and a pair of side walls rising from both side edges of the bottom wall, the resilient contact piece is provided on the bottom wall, and the vibration suppressing portion is provided on either one of the side wall and the ceiling wall.

3. A female connector, comprising:

the female terminal of claim 1;

a female housing including a female terminal accommodating portion, the female terminal being inserted into the female terminal accommodating portion; and a retainer, wherein:

the plurality of deflecting portions include an outer deflecting portion projecting outward of the connecting tube portion and an inner deflecting portion disposed inside the connecting tube portion, and the outer deflecting portion is disposed in front of the retainer inside the female terminal accommodating portion.

* * * * *